US008935838B2

(12) United States Patent
Skov et al.

(10) Patent No.: US 8,935,838 B2
(45) Date of Patent: Jan. 20, 2015

(54) COFFIN MADE FROM ENVIRONMENTALLY FRIENDLY MATERIAL

(75) Inventors: Bendt Skov, Copenhagen O (DK); Jakob Brahe-Pedersen, Hellerup (DK); Nils Thobo-Carlsen, Valby (DK)

(73) Assignee: Beco Consult APS, Copenhagen (DK)

( * ) Notice: Subject to any disclaimer, the term of this patent is extended or adjusted under 35 U.S.C. 154(b) by 0 days.

(21) Appl. No.: 13/643,240

(22) PCT Filed: Apr. 29, 2011

(86) PCT No.: PCT/DK2011/050143

§ 371 (c)(1), (2), (4) Date: Oct. 24, 2012

(87) PCT Pub. No.: WO2011/134479

PCT Pub. Date: Nov. 3, 2011

(65) Prior Publication Data

US 2013/0036583 A1 Feb. 14, 2013

(30) Foreign Application Priority Data

Apr. 29, 2010 (DK) ..... BA 2010 00076 U

(51) Int. Cl.

| | |
|---|---|
| ***A61G 17/00*** | (2006.01) |
| *A61G 17/007* | (2006.01) |
| *A61G 17/04* | (2006.01) |

(52) U.S. Cl.

CPC ..... *A61G 17/00* (2013.01); *A61G 17/0073* (2013.01); *A61G 2017/004* (2013.01); *A61G 2017/041* (2013.01)

USPC ..... 27/2; 27/4; 27/27; 16/424

(58) Field of Classification Search

USPC ..... 27/2, 14, 27, 35, 4; 16/424, 439

See application file for complete search history.

(56) References Cited

U.S. PATENT DOCUMENTS

| | | | | | |
|---|---|---|---|---|---|
| 3,253,312 | A | * | 5/1966 | Klosner | 27/35 |
| 4,034,447 | A | | 7/1977 | Kollmann et al. | |
| 4,237,590 | A | * | 12/1980 | Work | 27/35 |
| 4,249,289 | A | * | 2/1981 | Work | 27/35 |
| 4,253,220 | A | * | 3/1981 | Work | 27/35 |
| 4,315,353 | A | * | 2/1982 | Sorensen | 27/2 |
| 5,425,163 | A | * | 6/1995 | Von Braun et al. | 27/7 |
| 5,471,718 | A | * | 12/1995 | Harrill | 27/7 |
| 6,101,692 | A | | 8/2000 | Linville et al. | |
| 6,154,939 | A | * | 12/2000 | Woedl | 27/27 |

FOREIGN PATENT DOCUMENTS

WO 2009137894 A1 11/2009

* cited by examiner

*Primary Examiner* — William Miller

(74) *Attorney, Agent, or Firm* — Nath, Goldberg & Meyer; Jerald L. Meyer; Stanley N. Protigal

(57) ABSTRACT

A coffin in an environmentally friendly material with a special shape and fittings at the places where the coffin is to be lifted, which is new in that the coffin itself has vertical recesses directed inwards, which cover both the coffin box and the lid, and wherein at each side of the coffin box bottom, a transverse lever or pipe has been placed, and wherein said pipe or lever is through-going to each and across each recess.

3 Claims, 2 Drawing Sheets

COFFIN MADE FROM ENVIRONMENTALLY FRIENDLY MATERIAL

This is a National Phase Application filed under 35 U.S.C. 371 as a national stage of PCT/DK2011/050143, filed Apr. 29, 2011, an application claiming the benefit under 35 U.S.C. 119(e) Denmark Application No. BA 2010 00076, filed Apr. 29, 2010, the entire content of each of which is hereby incorporated by reference in its entirety.

TECHNICAL FIELD

The invention relates to a coffin, more specifically a coffin in an environmentally friendly material for burial and/or cremation.

BACKGROUND

Until now it has been known to have coffins in an environmentally friendly material such as pulp or a more specifically defined paper pulp making it necessary due to the material to stiffen the coffin in various ways in order for it to hold, and it has been particularly problematic with the durability or the strength of the load-bearing part, from where the coffin was to be carried.

DISCLOSURE OF THE INVENTION

The aspect of the disclosed technology is to create a coffin as mentioned above with improved or optimised strength and stability in the load-bearing parts.

The disclosed technology is novel in that the coffin itself has vertical recesses directed inwards, which cover both the coffin box and the lid, and wherein at each side of the coffin box bottom, a transverse lever or pipe has been placed, and wherein said pipe or lever is trough-going to each and across each recess.

Hereby, it is achieved that the bottom part of the coffin is reinforced, such that the coffin can be lifted completely without breaking in the middle. Further, the weight of the content of the coffin is evenly distributed through a transverse lever in each side.

Further, by the recesses, where the lever is accessible, it is achieved that one is closer to the load and that one is not disturbed by the sides on an otherwise broad coffin as the lifting means are integral with the coffin and not mounted on the outside of the coffin as is commonly known.

Further, the disclosed technology is new in that the transverse lever or pipe is arranged in an open handle surrounding the top part and the two sides of the lever or the pipe, thus allowing that the lever can be removed downwardly as the handle is open, and reversed the lever can be mounted from below.

Hereby, it is achieved that the lever can be easily mounted and dismounted if required or necessary.

Further, the disclosed technology is new in that the downwardly open handle only has a mounting opening, which is smaller than the pipe diameter, but which allows an ad hoc fixing or grip of the mounted pipe or lever.

Hereby, it is achieved that a mounted lever in each side can be fixed easily on an ad hoc basis until one wishes for this or these to be dismounted.

Further, the disclosed technology is new in that in the base and parallel with the levers, the coffin bottom has several longitudinal and upwardly pointing tabs or fins of the same height as the coffin base for stabilisation of the strength of the coffin by lifting.

Hereby, it is achieved that the coffin is considerably stabilised from breaking.

BRIEF DESCRIPTION OF THE DRAWINGS

The disclosed technology is explained in detail below with reference to the drawings, in which.

DETAILED DESCRIPTION OF THE INVENTION

Figure 1:
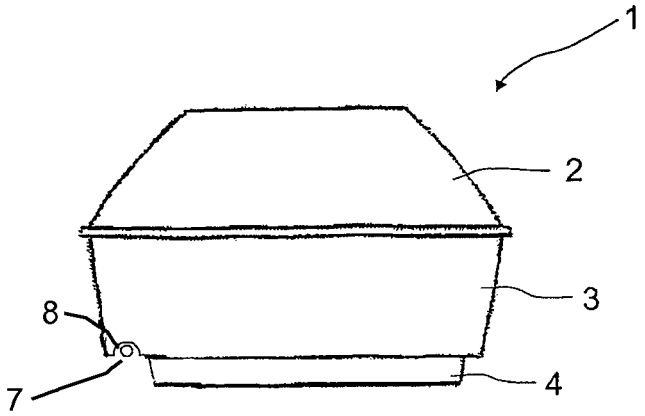
FIG. 1 shows a coffin seen from the end of the coffin box, its base and its lid.

FIG. 1 shows a coffin 1, which can be a coffin, i.e. for burial, cremation or a casket, which has a lid 2, a box 3 and a bottom or base 4. The box 3 and the lid 2 enclose the volume which is to be used for storage, such as storage of a body, which is to be buried in the ground or cremated in the crematorium. The lid 2 can be lifted from the box 3 or the coffin, either as a whole or it can be divided into sections, which can be lifted from the box 3 or the coffin independently from each other. The bottom 4 or the base gives the box a stable foundation on which to stand, e.g. when showing the contents of the coffin 1 or during transportation. Further, the base 4 results in the box 3 being elevated from the surface on which the coffin is placed such that the bottom part of the box 3 is not in contact with the surface on which the base is placed.

Additionally, the coffin tabs or fins 10 are parallel with the hand grips or pipe, and extend to the same height as the base of the coffin for stabilizing the coffin when the coffin is lifted.

Figure 2:
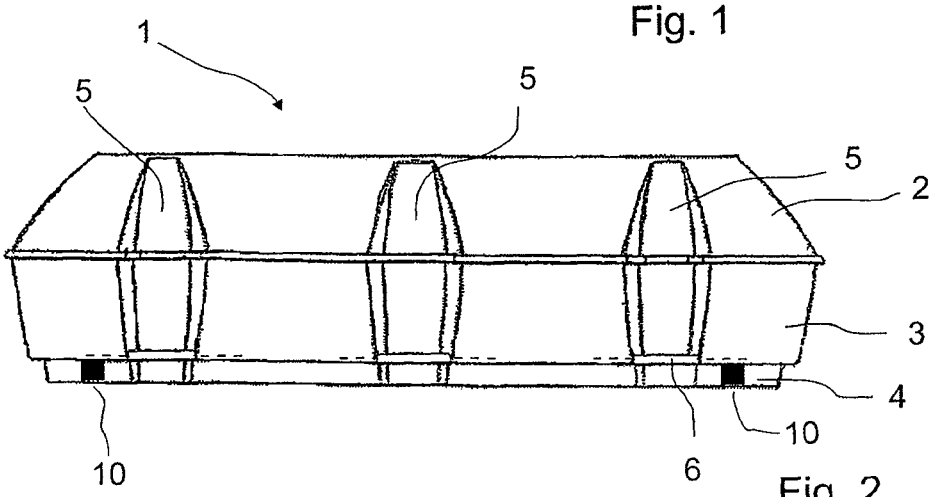
FIG. 2 shows a coffin seen from the side, where three recesses along the coffin profile are shown clearly, and where the through-going carrying handle at the coffin base is shown, In this embodiment, the recess itself will be sideways supporting, also for the person lifting the coffin, and it is easier to steer and lift the coffin the closer one is to the centre line of the coffin.
Figure 4:
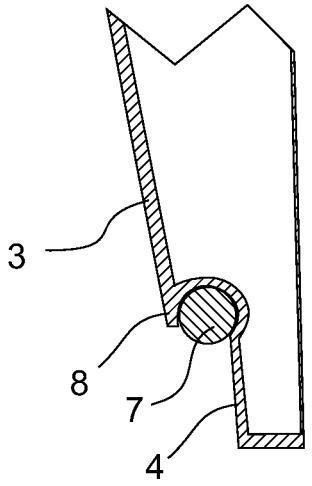
FIG. 4 shows a coffin mounting opening and hand grip.

FIG. 2 shows a coffin seen from the side and FIG. 4 shows a close-up of an open handle arrangement, where the lid 2 covers up the inner volume of the box 3. On the sides of the box 3 and the lid 2, the coffin 1 has vertical recesses 5 directed inwards, which minimise the transverse (across the longitudinal direction of the coffin) perimeter of the coffin 1 in the area where the recess is placed. In the bottom of the box, just above the base 4, bars or pipes are placed, which cross from one end of the recess to the other end of the recess in the longitudinal direction of the coffin 1, which function as carrying handles for the coffin. The bars or pipes 6 may be inserted into the side of the recess through openings or they may be embedded in an open handle 8, which surrounds the top part and the two sides on the bar or the pipe 6, such that the bar or pipe 6 can be dismounted downwards as the handle is open or in reverse order, where it can be mounted downwards and into the open handle 8. The ends 7 of the bars or pipes 6, which are inserted into the open handle 8 or into the coffin, are shown as being behind the wall of the box.

Figure 3:
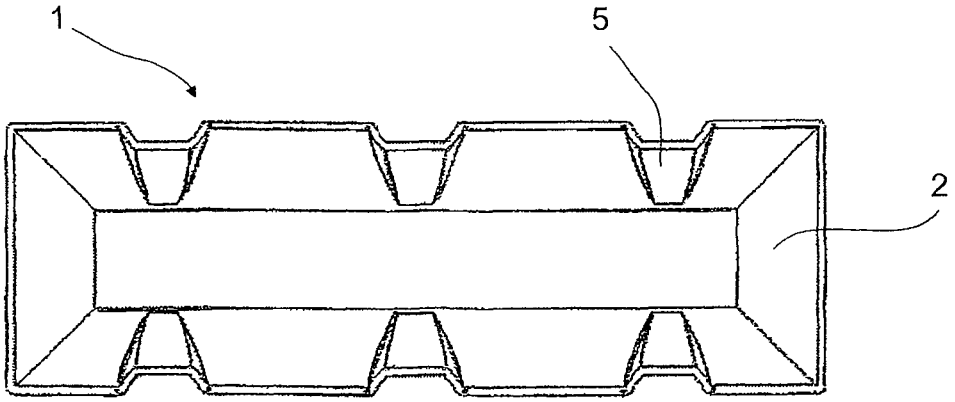
FIG. 3 shows a coffin seen from above, where it is shown how close to the centre line of the coffin the recess is arranged.

FIG. 3 shows the coffin 1 seen from above, where the recesses 5 can be seen from above and the way said recesses minimise the perimeter of the coffin.

As a result of this, the bars or pipes 6 may be inserted into the very material of the box 3, which results in that it is not necessary for the carrying handles to be mounted separately to the outer casing of the box 3, where a separately mounted carrying handle requires a complicated mounting. Further, as a result of this, when the coffin is to be carried, the recesses ensure that the arms, which carry the coffin, can be placed vertically above the bars or the pipes 6 and that the outer diameter of the coffin is not pressed into the arm, which is normal for known coffins.

Further, as a result of this, the bars or pipes can be dismantled from the coffin before it is lowered into the ground or is stored, which means that the carrying handles can be made of another material than the environmentally friendly material of the coffin. This means that the carrying handles can be made of a metal or plastic, which means that the carrying capacity needs not be questioned as its strength is strong enough to at least carry the coffin. This ensures that when a coffin, e.g. a casket, is carried, then the risk of the carrying handles breaking or losing their carrying capacity is minimal and that the persons carrying the coffin can carry it safely without fearing to lose the coffin.

FIG. 4 shows a coffin mounting opening for the downwardly open handle. The mounting opening is smaller than the hand grip or pipe diameter. Further, the mounting opening allows for ad hoc fixing or gripping of the mounted pipe or lever.

The invention claimed is:

1. A coffin made from an environmentally friendly material wherein the coffin has vertical recesses directed inwards which cover both a coffin box and a lid, and wherein at each side of a bottom of the coffin box, a transverse hand grip or pipe has been placed, wherein said hand grip or pipe is through-going to each and across each recess, and when the coffin lid is on the coffin box such that the coffin is in a closed arrangement, the vertical recesses have an alignment defining a single vertical recess that extends along the coffin box and the coffin lid, further comprising a base juxtaposed to and beneath the coffin box bottom, and characterized in that the coffin box bottom has several tabs or fins parallel with the hand grips or pipe, and extending to the same height as the base of the coffin for stability of the coffin when lifting.

2. The coffin according to claim 1, further comprising a downwardly open handle, and characterized in that the through-going hand grip or pipe is arranged in downwardly open handle surrounding a top part and each of two sides of the hand grip or pipe, thus allowing the hand grip or pipe to be removed downwardly via said downwardly open handle as the handle is open, and in reverse where the hand grip or pipe can be mounted from below via said downwardly open handle.

3. The coffin according to claim 1, further comprising a downwardly open handle, characterized in that the downwardly open handle has a mounting opening, which is smaller than a diameter of the hand grip or pipe, but which allows fixing or attachment of the hand grip or pipe.

* * * * *